US010681948B1

(12) United States Patent
Tedder

(10) Patent No.: US 10,681,948 B1
(45) Date of Patent: Jun. 16, 2020

(54) CONVERTIBLE GARMENT SYSTEMS AND RELATED DEVICES AND METHODS

(71) Applicant: Amy L. Tedder, High Point, NC (US)

(72) Inventor: Amy L. Tedder, High Point, NC (US)

( * ) Notice: Subject to any disclaimer, the term of this patent is extended or adjusted under 35 U.S.C. 154(b) by 0 days.

(21) Appl. No.: 15/159,352

(22) Filed: May 19, 2016

Related U.S. Application Data

(63) Continuation of application No. 13/248,713, filed on Sep. 29, 2011, now Pat. No. 9,375,055.

(60) Provisional application No. 61/388,198, filed on Sep. 30, 2010.

(51) Int. Cl.

| | |
|---|---|
| ***A41F 15/00*** | (2006.01) |
| ***A41C 3/08*** | (2006.01) |
| ***A41D 7/00*** | (2006.01) |
| ***A44B 11/04*** | (2006.01) |
| ***A44B 11/12*** | (2006.01) |

(52) U.S. Cl.
CPC ..... *A41F 15/002* (2013.01); *A41C 3/08* (2013.01); *A41D 7/00* (2013.01); *A44B 11/04* (2013.01); *A44B 11/12* (2013.01)

(58) Field of Classification Search
CPC ..... A41C 3/00; A41D 7/00
See application file for complete search history.

(56) References Cited

U.S. PATENT DOCUMENTS

| | | | | |
|---|---|---|---|---|
| 911,783 | A * | 2/1909 | Traver | A41F 11/02 2/336 |
| 1,616,267 | A * | 2/1927 | Laird | A41F 15/002 2/323 |
| 1,689,977 | A | 10/1928 | Stirton | |
| 2,363,017 | A | 11/1944 | Plehn | |
| 2,535,641 | A * | 12/1950 | Levy | A41F 1/006 24/301 |
| 3,506,014 | A * | 4/1970 | Sorenson | A41C 3/0021 450/60 |
| 6,186,863 | B1 * | 2/2001 | Kim | A41F 15/002 450/1 |
| 2002/0022434 | A1 | 2/2002 | Plourde et al. | 450/86 |
| 2004/0006853 | A1 | 1/2004 | Yang | 24/197 |

FOREIGN PATENT DOCUMENTS

JP WO2012098678 * 7/2012

* cited by examiner

*Primary Examiner* — Alissa J Tompkins
*Assistant Examiner* — Brieanna Szafran
(74) *Attorney, Agent, or Firm* — MacCord Mason PLLC

(57) ABSTRACT

Convertible garment systems and related devices and methods are shown and described. In one example, a convertible garment system includes a bathing suit and a pair of detachable-strap-interfaces, each configured to removably connect to the bathing suit's lower straps, and removably connect to the bathing suit's upper straps, thereby creating a second configuration for the pair of upper straps. In another example, a device includes at least one detachable-strap-interface for converting a bathing suit.

23 Claims, 19 Drawing Sheets

CONVERTIBLE GARMENT SYSTEMS AND RELATED DEVICES AND METHODS

RELATED APPLICATIONS

This application is a divisional of application Ser. No. 13/248,713 filed on Sep. 29, 2011, which claims priority to Provisional Application No. 61/388,198 filed on Sep. 30, 2010.

FIELD OF TECHNOLOGY

The current disclosure relates generally to convertible garment systems and, more particularly, to convertible systems designed, for example, to improve the fit or style of a garment, e.g., a bathing suit.

BACKGROUND

FIG. 1 illustrates a known example of a bathing suit 2. Suit 2 includes a pair of breast cups. Breast cups 4 may be connected on their front by a strap, e.g., strap 6, or by an integral construction or some other piece of fabric.

A pair of upper straps 10*a* and 10*b* are connected to the breast cups and extend upwardly for connecting behind the neck of a user. Breast cups are considered to be inclusive of any material for covering the breasts, e.g., single layer fabric cut to cover the breast may be considered a breast cup. Connection may be achieved in a variety of ways, e.g., clip, bow or knot 10*c*.

A pair of lower straps 12*a* and 12*b* are connected to the pair of breast cups and extendable laterally for connecting behind the back of the user. Connection may be achieved in a variety of ways, e.g., clip, bow, knot, integral, etc.

The described configuration of how the suit's breast cups are secured to a user may be considered a first configuration. In first configurations, the user's neck may be considered to support the load of the user's breast. Applicant believes that with some suits, for example, the first configuration may create excessive load bearing or undesirable pressure on the neck, e.g., if suits or worn too long, if straps are too thin, if the load is too large, etc. Excessive load bearing may result in a variety of problems, including, inter alia, headaches. Further, the acute pressure created by clip or knot 10*c* on the user's spine or neck may contribute to headaches, nerve, circulation, or other problems. Further, while the suit 2 is illustrated a bikini, e.g., having a separate bottom 14, suits of other constructions, e.g., one piece, may be considered to have a first configuration as disclosed herein.

It is to any combination of these or additional problems that the current disclosure is directed.

SUMMARY

The current disclosure is directed to a variety of systems, devices, and methods. In one example, a convertible garment system includes a garment and at least one detachable-strap-interfaces (DSI) configured to removably connect to the garment's lower straps and removably connect to the garment's upper straps, thereby creating a second configuration for the pair of upper straps. The garment may be, for example, a bathing suit or similar garment having a halter top.

In one example, a device includes a detachable-strap-interface (DSI). The DSI comprises a buckle-end configured to attach to at least one of a garment's upper straps and a channel-portion configured to attach to at least one of a garment's lower straps. DSIs may also be used in combination with other garments having upper straps for connecting behind the neck of a wearer.

In one example, a method includes a method of converting a bathing suit to a second configuration. In this example, the method comprises obtaining a bathing suit designed to have a first configuration, attaching one of the suit's pair of upper straps to a first detachable-strap-interface (DSI); and attaching the first DSI to at least one of the pair of lower straps. Methods also include performing similar steps with other garments.

The above summary was intended to summarize certain embodiments of the present disclosure. Systems, devices and methods will be set forth in more detail in the figures and detailed description below. It will be apparent, however, that the detailed description is not intended to limit the present invention, the scope of which should be properly determined by the appended claims.

DETAILED DESCRIPTION OF EXAMPLES

Figure 1:
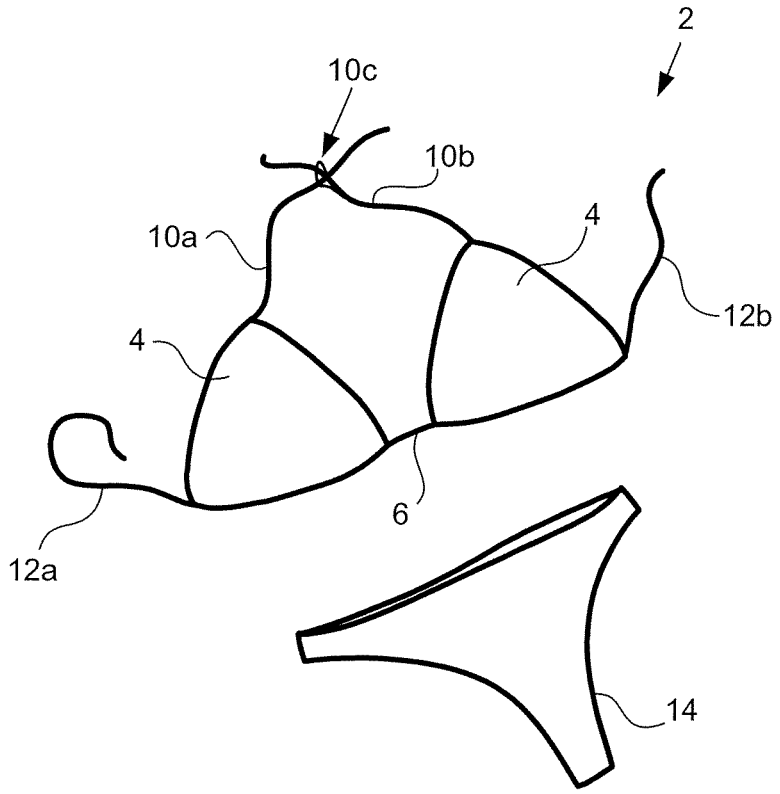
FIG. 1 illustrates an example of a known bathing suit.
Figure 2A:
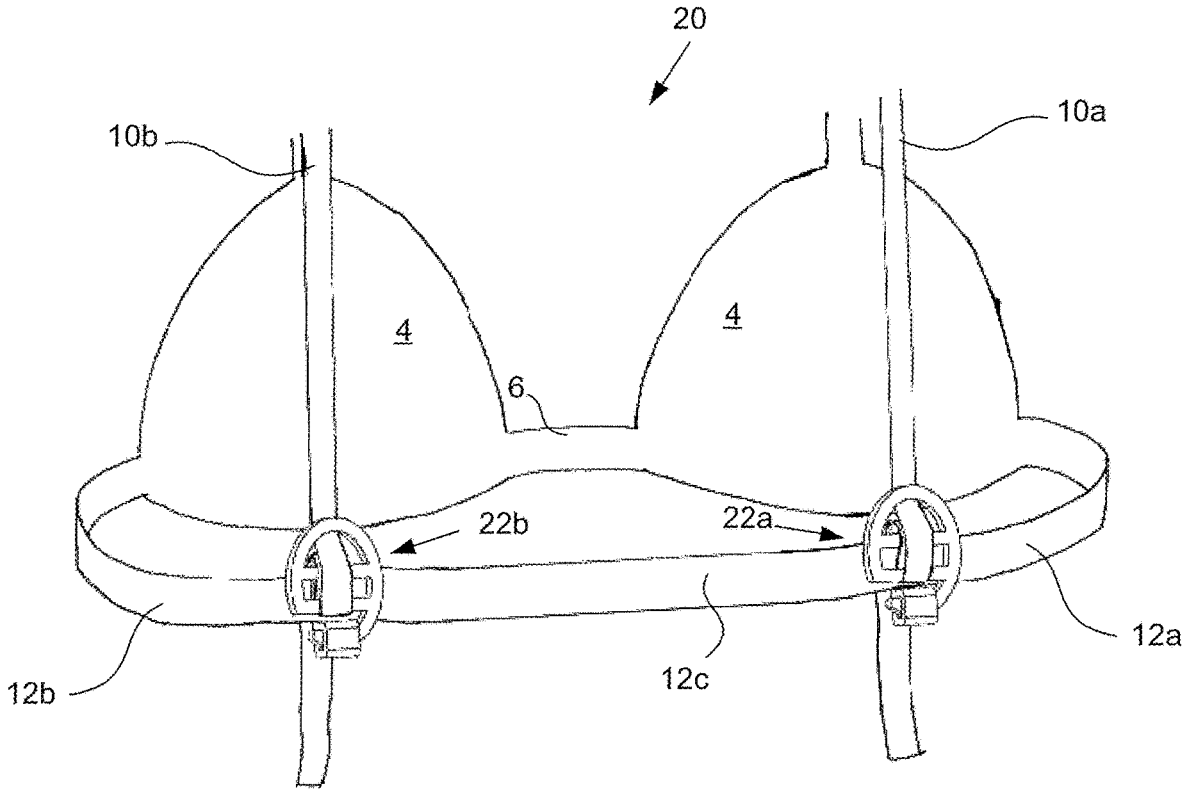
FIG. 2A illustrates an example of a system constructed according to one example of the disclosure.
Figure 2B:
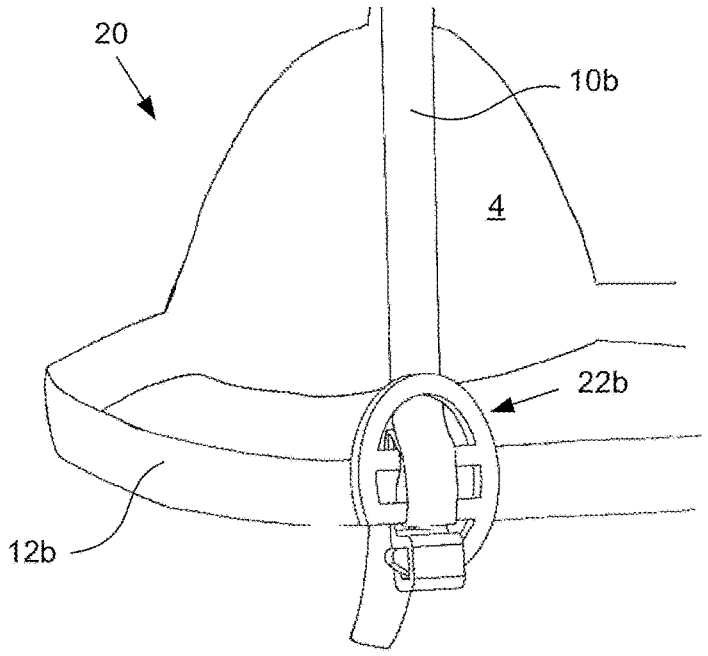
FIG. 2B illustrates a close-up view of one of the DSIs shown in FIG. 2A.

The current disclosure is directed to a variety of systems, detachable-strap-interfaces (DSI) and related methods. FIGS. 2A and 2B illustrate an example of a convertible garment system 20 for a user. System 20 may include a variety of bathing suits or other garments that are known in the art, e.g., any variety of halter tops that connect behind the neck of the user. For purposes of illustration and understanding, system 20 will share some of the call-out numbers used to describe the suit in FIG. 1. System 20 includes a pair of breast cups 4 connected on their front by strap 6. A pair of lower straps 12*a* and 12*b* are connected to the pair of breast cups and extendable laterally for connecting behind the back of the user in area 12*c*, using a bow, knot, clip, etc.

Pair of upper straps 10*a* and 10*b* are connected to the breast cups and extend upwardly. In contrast to FIG. 1, however, where straps 10*a* and 10*b* connect in a knot or bow around the neck of the user, straps 10*a* and 10*b* do not connect behind the neck of a user, but extend over a user's shoulders to connect to detachable-strap-interfaces (DSI) 22*a* and 22*b*. DSIs are configured to removably connect to the lower straps 12*a* and 12*b* and removably connect to the upper straps 10*a* and 10*b*. The result is a second configuration for the pair of upper straps, which reduces load bearing on the neck and acute pressure created by knot 10*c* behind the user's neck (not present in the second configuration).

Figure 3:
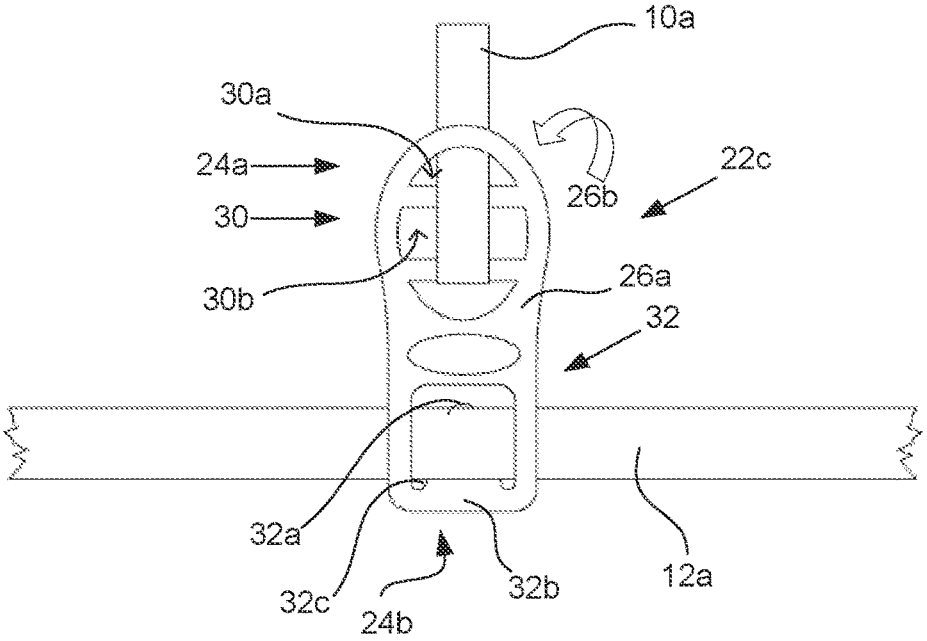
FIG. 3 illustrates a close-up view of another example of a DSI.

FIG. 3 illustrates a close-up view of one embodiment example of a DSI, which may be considered DSI 22*c*. DSI 22*c* Includes a buckle-end 24*a* and channel-portion 24*b*. DSI may also be considered to have a body side (BS) and an away side (AS). In FIG. 3, side 26*a* is the BS and the opposite side, 26*b*, is the AS, however, relative positioning may vary. Upper strap 10*a* is removably connected at the buckle-end 24*a* of the DSI and the lower strap 12*a* is removably connected at the channel-portion 24*b* of the DSI.

Connection at the buckle-end may be achieved in a variety of ways, for example, using at least one aperture 30 configured to attach to at least one of the pair of upper straps by threading the straps through at least one aperture. In this example, apertures 30 include an upper aperture 30*a* and lower aperture 30*b* to facilitate securing straps. Additional apertures may be used to provide various levels of adjustment or mending of the tag end of the strap. It should be clear, that aperture shape may vary from example to example. Additionally, some buckle-ends are considered to include other configurations for attachment, e.g. clamps, clips, etc. for connecting to at least one upper strap.

Connection at the channel-portion may similarly be achieved in a variety of ways, for example, using a channel, e.g., channel 32. Channel 32 includes a top end 32*a* and a lower end 32*b*, and is openable at its top end, thereby allowing at least one of the lower straps to be received by the channel. Channel 32 is closed at its lower end 32*b*, thereby creating shelf 32*c*. Shelf 32*c* transfers the downward pressure of the user's breast from the user's neck to the lateral straps, thereby allowing the user to optionally employ a second configuration as needed. Channels may additionally be biased to provide a clamping force, for example, as illustrated.

Figure 4:
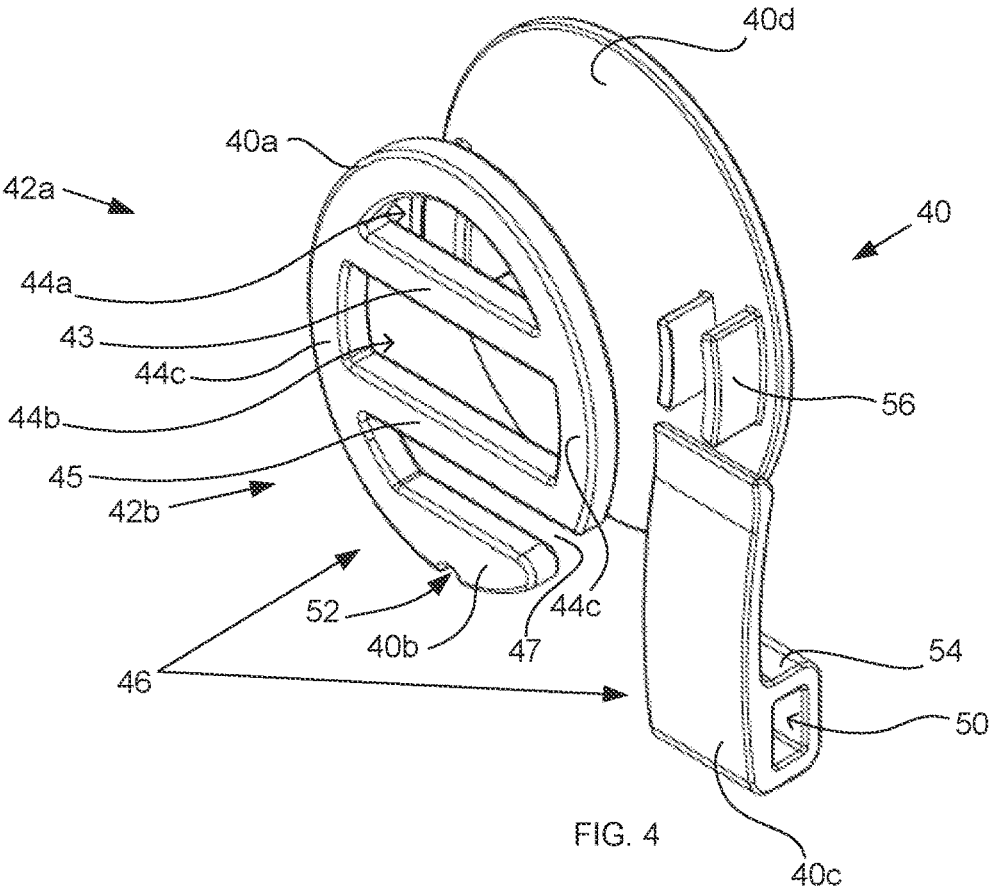
FIG. 4 illustrates another example of a DSI.

FIG. 4 illustrates an exploded view of another DSI embodiment example, which may be considered similar to the DSI shown in FIGS. 2A and 2B. DSI 40 includes a buckle-end 42*a* and a channel-portion 42*b*. DSI 40 is configured such than an upper strap can removably connect at the buckle-end, and such that a lower strap can removably connected at the channel-portion. In this example, DSI 40 includes a base plate 40*a* defining a finger 40*b*, a channel arm 40*c*, and an optional face plate 40*d*. Pieces 40*a*, 40*c* and 40*d* may be readily manufactured and assembled to create the functional DSI. Base plate 40*a* may also include an upper arm 43 formed between an upper aperture 44*a* and a lower aperture 44*b*. An open aperture 47 is defined on one side by a side arm 44*c*, above by lower arm 45, and below by finger 40*b*.

Base plate 40*a* defines at least one aperture configured to attach to at least one of the pair of upper straps. For example, attachment may be achieved by threading the straps through upper aperture 44*a* and lower aperture 44*b*. Connection at the lower end may be achieved using channel 46. Channel 46 is formed by channel arm 40*c* and base plate 40*a*. As seen, channel arm 40*c* defines an aperture 50 for receiving finger 40*b*. Channel arms may lock in place using a variety of techniques, e.g. adhesive, sonic welding, etc. In the example depicted, the channel arm snaps into place using friction created by an internal projection (not shown) shaped to be received by recess 52. The upper end of the resultant channel is open for receiving at least one lower strap. Channel shelf 54, for applying upward pressure to the lower straps, is also visible in this figure.

Face plate 40*d* may optionally attach to the base plate. Face 40*d* may serve a variety of functions, e.g., concealing the threaded or channeled straps, distributing pressure over a wider surface of the back, providing advertising indicia, providing a variety of colors or shapes to better coordinate with existing suits, etc. Somewhat similarly, base plate shapes may be a variety of ornamental shapes as well. In the example shown, face plate 40*d* includes projections 56 configured to interface with side arms 44*c* of lower aperture 44*b*. Accordingly, side arms 44*c* are shaped to interface with projections 56. In other examples, faces may interface in other ways, e.g., using projections at various positions to interface with other parts of the base plate.

Figure 5A:
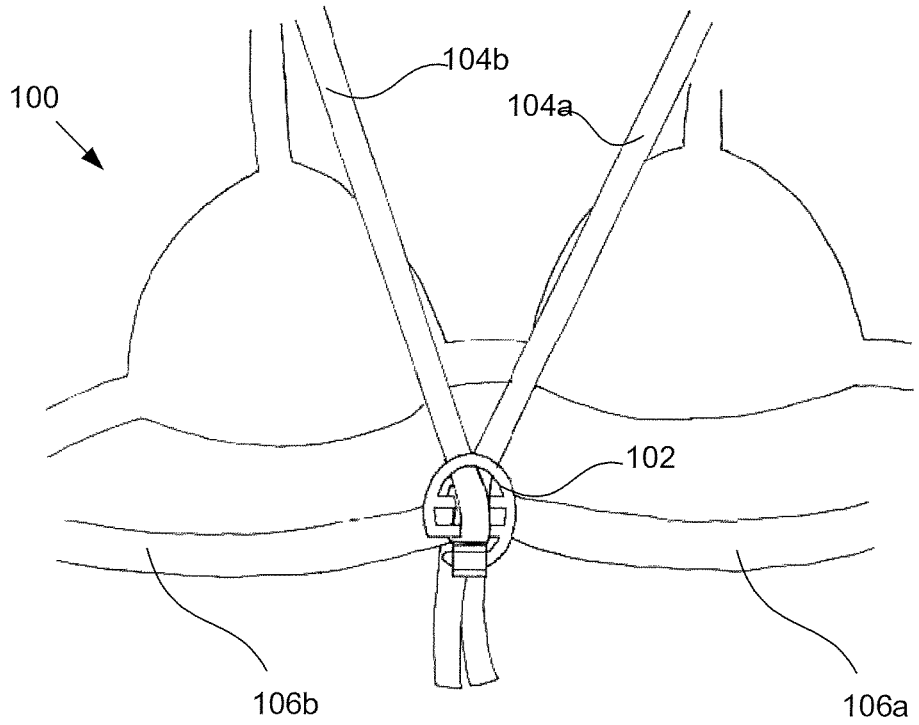
FIGS. 5A and 5B illustrate additional system configurations.
Figure 5B:
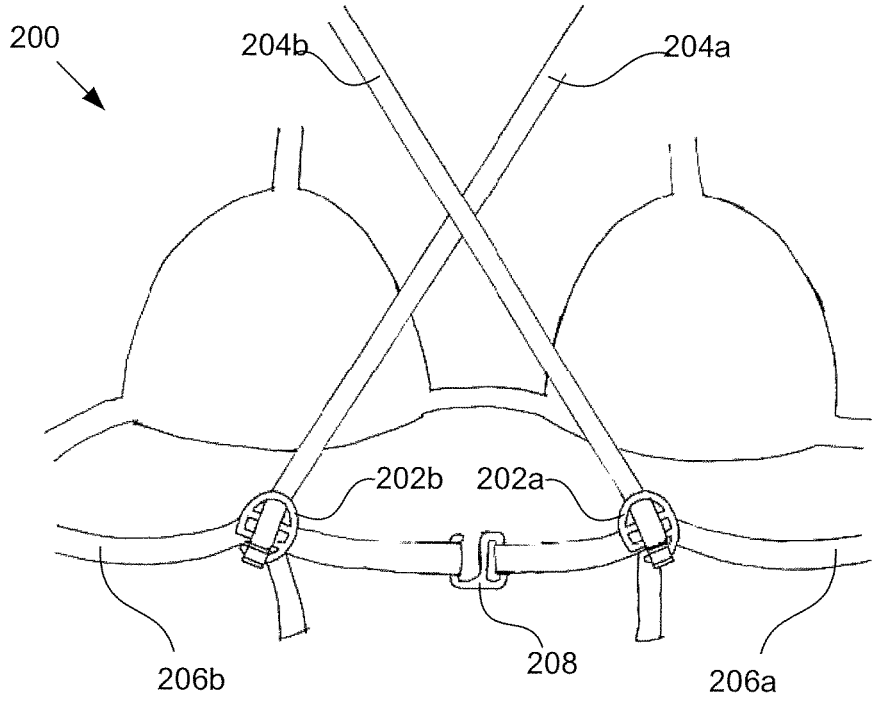

Using any of the DSIs disclosed herein, a variety of second configurations may be achieved. FIG. 5*a*, for example, illustrates another system 100 in a second configuration where a single DSI 102 is removably connected to both upper straps 104*a* and 104*b*. DSI 102 is also removably connected to lower strap 106*a* and could alternatively be connected to strap 106*b*, or to both straps 106*a* and 106*b*. FIG. 5*b* illustrates another system 200 in a second configuration where a pair of DSI 202*a* and 202*b* are removably connected to upper straps 204*a* and 204*b*. In this example, however, strap 204*a* and 204*b* are crossed such that strap 204*a* is connected to DSI 202*b*, and strap 204*b* is connected to DSI 202*a*. DSIs are removably connected to lower straps 206*a* and 206*b*. Clasp 208 is also illustrated, but lower straps may be connected in other ways as noted previously.

Figure 6A:
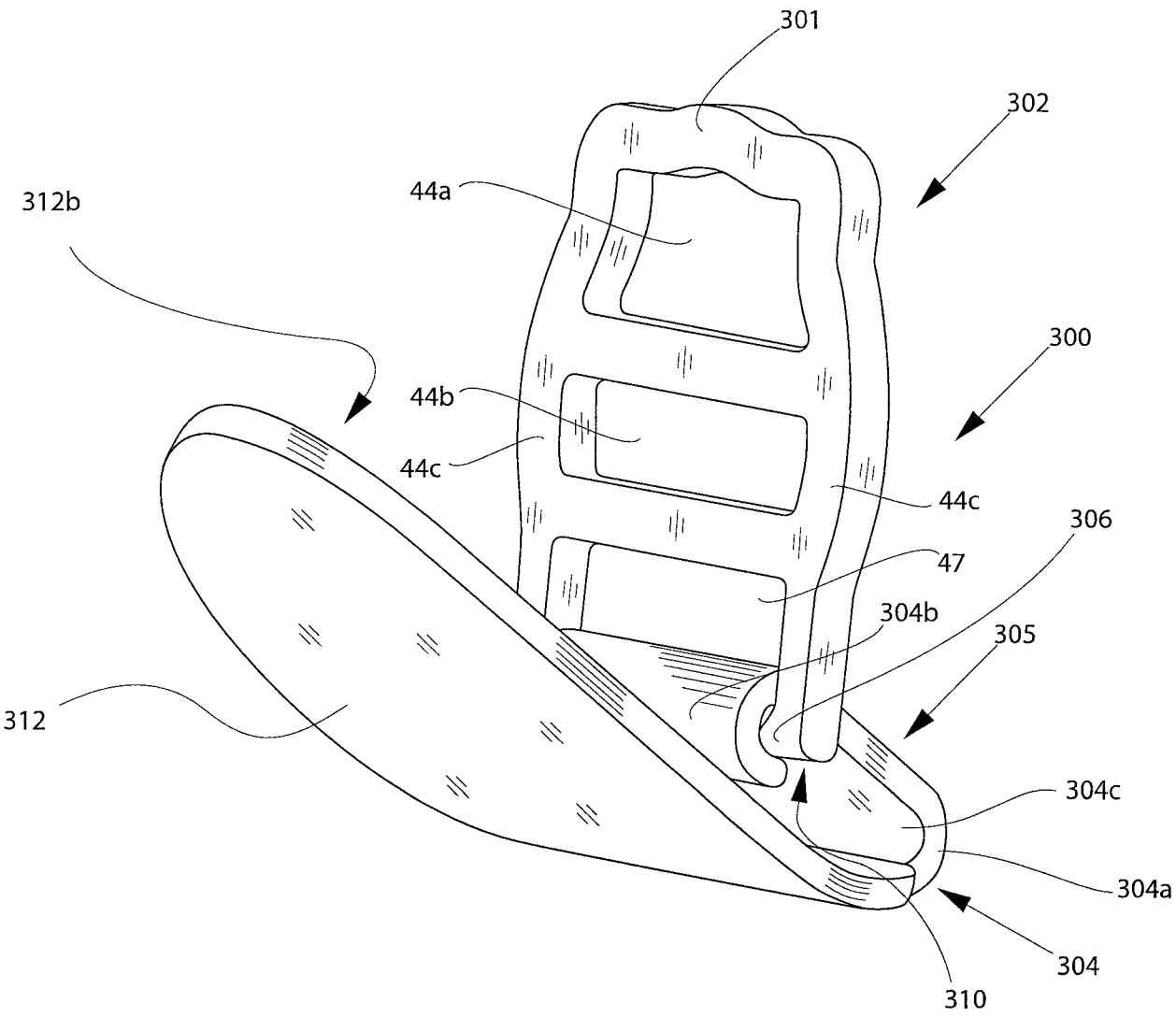
FIGS. 6A, 6B, and 6C illustrate another example of a DSI.
Figure 6B:
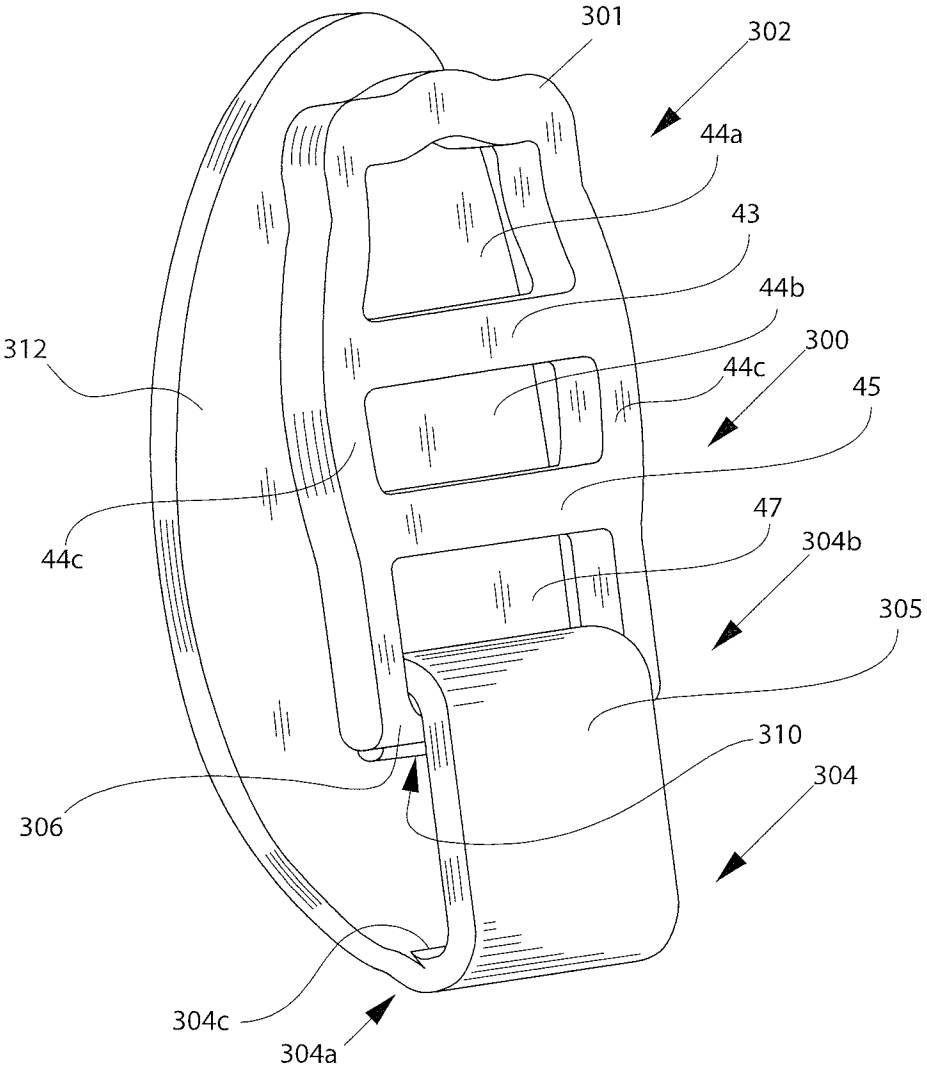
Figure 6C:
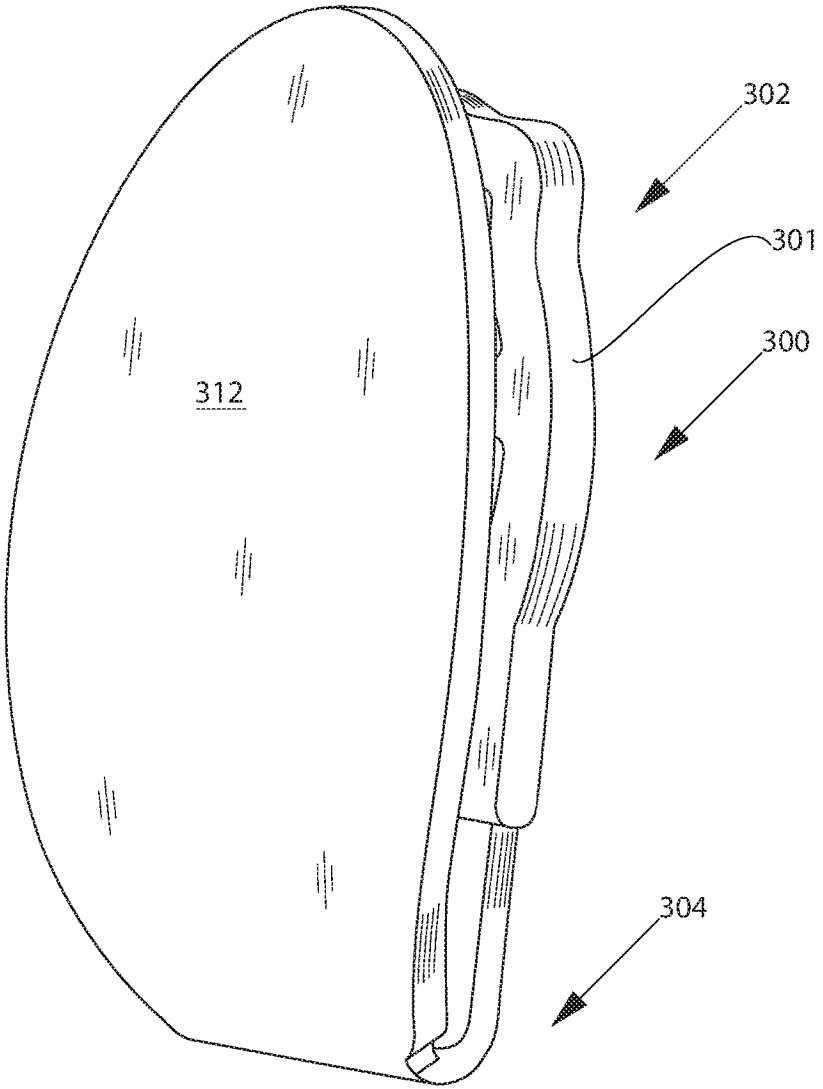

FIGS. 6A, 6B, and 6C illustrate various views of DSI 300, another DSI embodiment example. DSI 300 includes a base plate 301, a channel plate 312, and a channel arm 305. DSI 300 also includes a buckle-end 302 configured to attach to at least one of the upper straps. DSI 300 also includes a channel-portion 304 having a lower pivot end 304*a* and a top end 304*b* positioned above the lower end. Channel 304 also includes shelf 304*c* for applying upward pressure to at least one of the lower straps. This example differs somewhat from previous examples for at least the reason that the channel-portion is pivotally attached to the buckle-end. In such examples, the buckle-end can readily be attached to an upper strap of a suit or garment, and the channel-portion can be pivoted open, similar to the view seen in FIG. 6A, thereby creating a self guiding structure that guides the lower strap of the suit or garment into the channel. The buckle end 302 of the base plate 301 may include upper aperture and a lower aperture. The upper aperture 44*a* and the lower aperture 44*b*, in this example, are separated by an upper arm 43 and framed on each side by side arms 44*c*. The upper aperture 44*a* may be configured to receive an upper shoulder strap of the garment and removably connect to at least one of the upper shoulder straps. The pivot end 304 of the base plate 301 may define a bottom aperture 47 that is separated from the lower aperture 44*b* by a lower arm 45 with the bottom aperture defined on at least one side by a pivot bar 306. The channel-portion 304 may removably attach to the base plate 301 by way of the lower pivot end 304*a* and be configured to removably connect to at least one of the lower straps. The channel portion 304 may form the channel arm 305. The channel arm may have a substantially u-shaped pivot recess at one distal end configured to receive the pivot bar 306 and a channel shelf 304*c* including a curved lower end that attaches to the channel plate and forms a shelf configured to enclose at least one of the lower straps in an interior face of the channel portion. Once the lower strap has been received by the channel, the DSI may be closed similar to the illustration in FIG. 6B. The upward force created by the upper strap attached to the buckle, and the downward force created by the lower strap received by the channel also facilitate the closed position of the DSI when in use, forming a clamping force between the channel plate and the channel portion. Therefore, the channel plate may be variable between a first clamped position that is substantially parallel (see FIG. 6B) and a second retracted position that places the channel plate in a non-parallel position (see FIG. 6*a*).

Pivotal attachment may be achieved in a variety of ways. In this example, base plate 301 includes a pivot bar 306, which is received by a pivot recess 310 of channel arm 305. Pivotal attachment may be received by a variety of different hinge-type structures or may be achieved by the use of resilient material.

Channel plates may also include a cover, e.g., cover 312*a* extending upwardly from channel portion 304. Covers will typically be distally positioned relative to the user, e.g., to cover the strap, buckle, etc. Covers 312*a* may also provide some self-guiding function as their back side 312*b* provides a surface over which lower straps may travel in route to channels. In many examples, covers will have a height that is sufficient to cover the base plate or buckle, but in other examples, covers may have lesser heights.

Figure 7A:
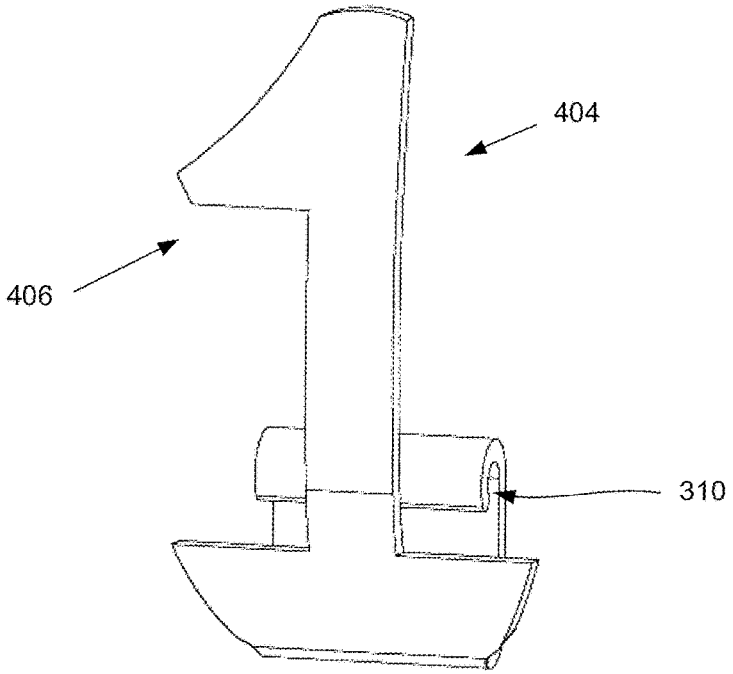
FIGS. 7A and 7B illustrate DSI channel plate examples.
Figure 7B:
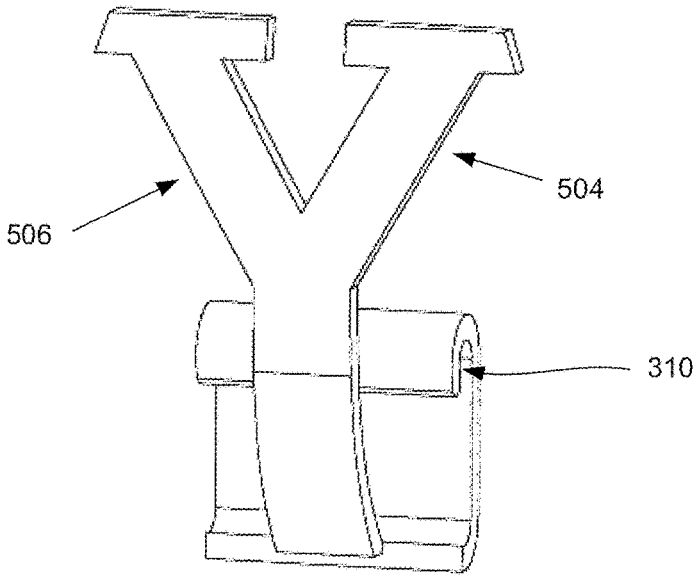

Covers 312*a* may also include any combination of ornamentation or advertising indicia. FIGS. 7A and 7B for example, illustrate channel plates 404 and 504, which may be pivotally attached to base plate 301 by interfacing pivot bar 306 with pivot recesses 310. As seen, covers 406 and 506 have ornamentation.

Figure 8:
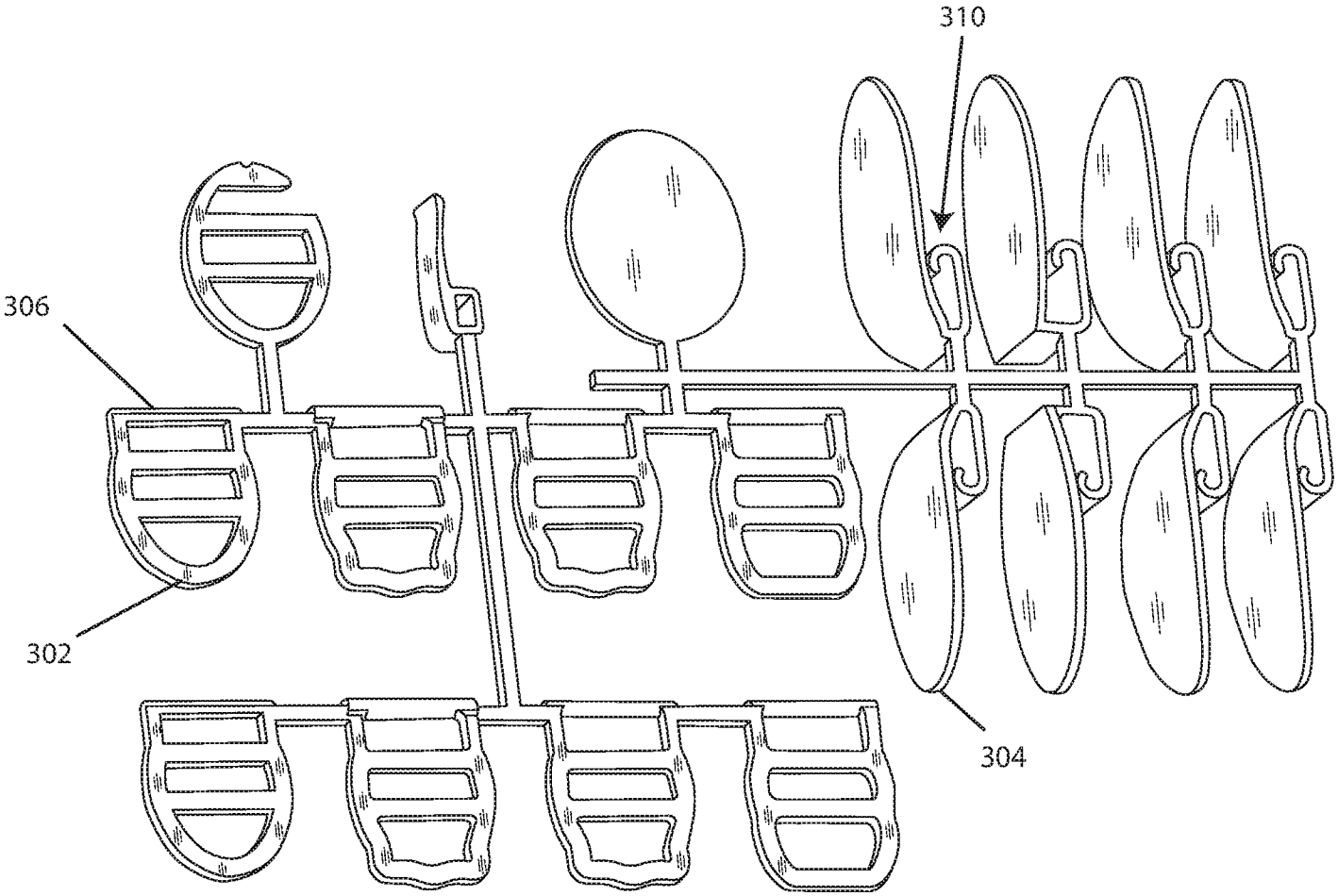
FIG. 8 illustrates a manufacturing layout example.

FIG. 8 illustrates an example of various parts of DSI described above in a manufacturing layout.

Figure 9:
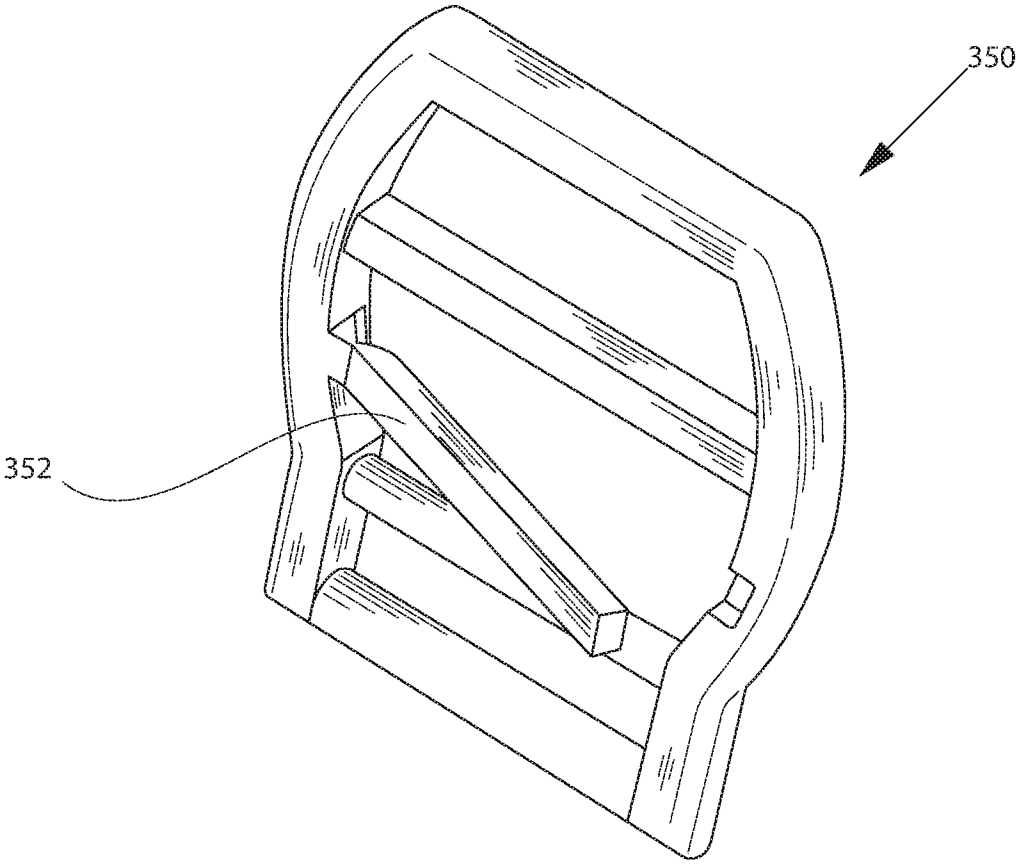
FIG. 9 illustrates another example of a DSI buckle-end.

FIG. 9 illustrates another buckle-end example, referred to as 350, including resilient arm 352, which may further define an aperture. Resilient arms may further secure straps attached to the buckle-end.

Figure 10:
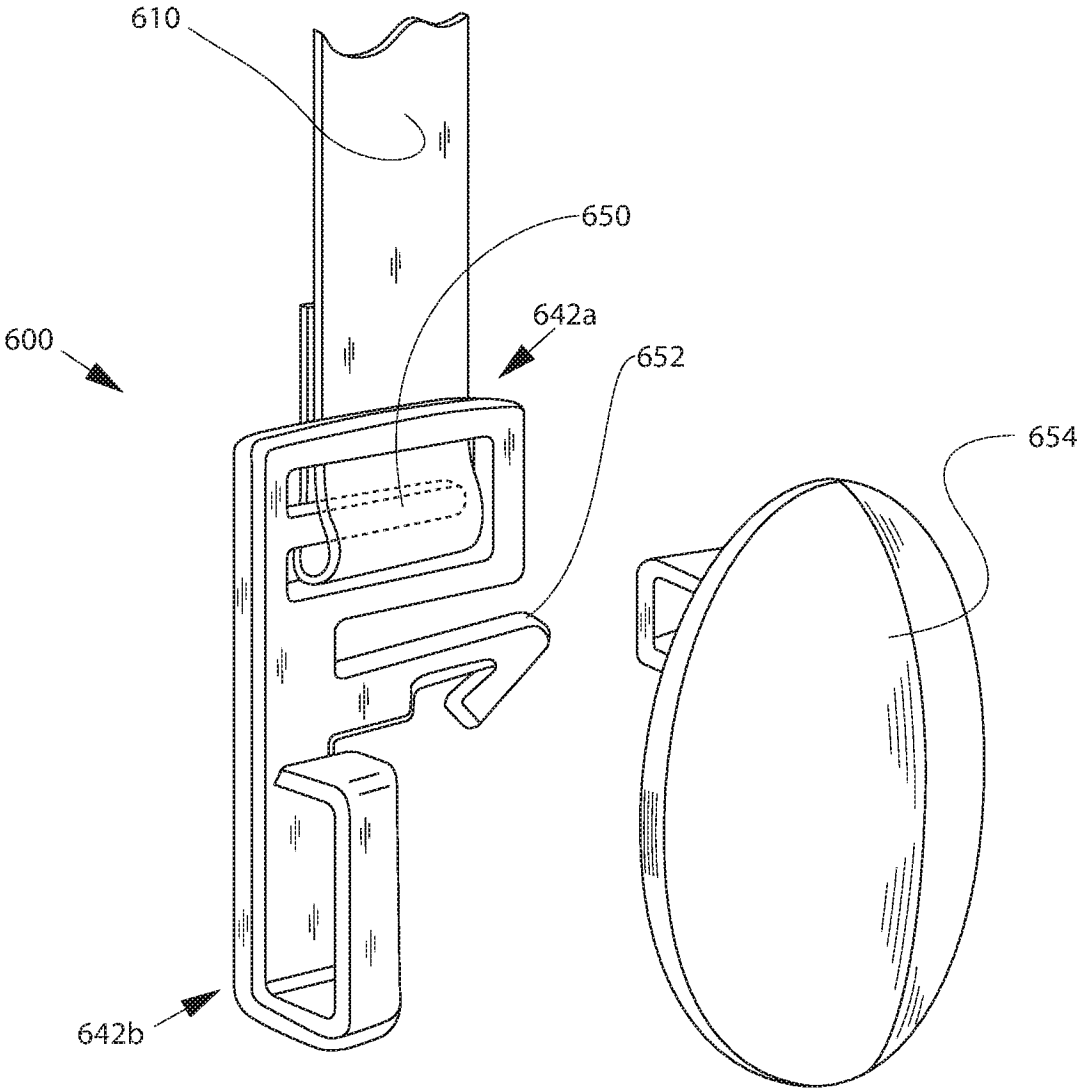
FIG. 10 illustrates another example of a DSI.

FIG. 10 illustrates another DSI embodiment example 600. DSI 600 includes buckle-end 642*a* and channel-portion 642*b*. An upper strap 610 is seen interfaced with buckle-end 642*a*. In this example, buckle-end 642*a* also includes a resilient arm 650 to further secure strap 610. DSI 600 also includes a cover interface 652 for interfacing with cover 654. Covers may vary from example to example, e.g. they may be ornamental as described previously. Covers may also provide an additional clamping force in some examples.

Figure 11:
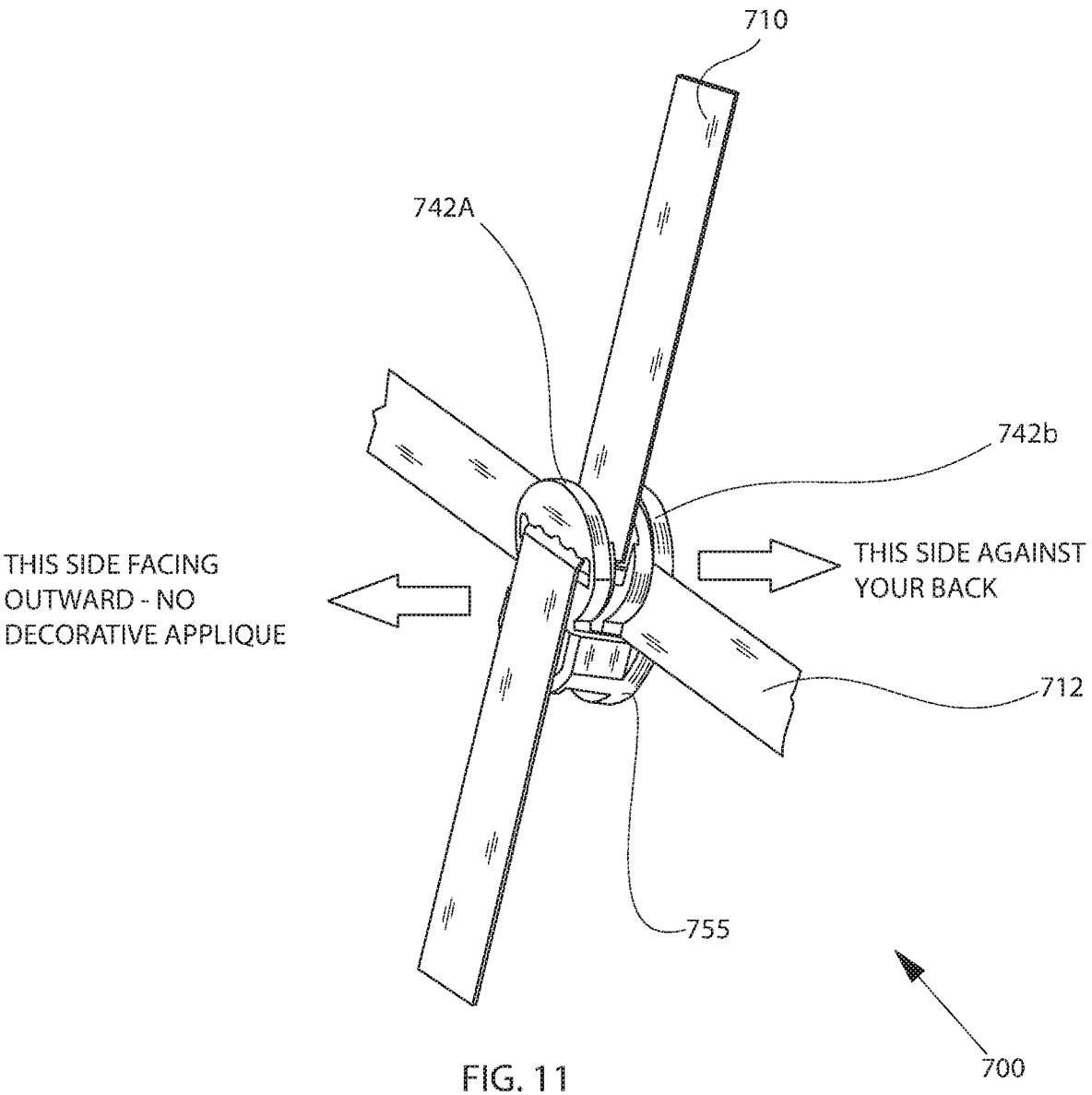
FIG. 11 illustrates another example of a DSI.

FIG. 11 illustrates another DSI example 700, interfaced at buckle-end 742*a* with an upper strap 710, and interfaced at channel-portion 742*b* with a lower strap 712. In this example, buckle-end 742*a* includes a single aperture configured to secure the upper strap. DSI 700 also includes a flat surface 755 for positioning against the user's body. Surface 755 may be cushioned in some examples.

Figure 12:
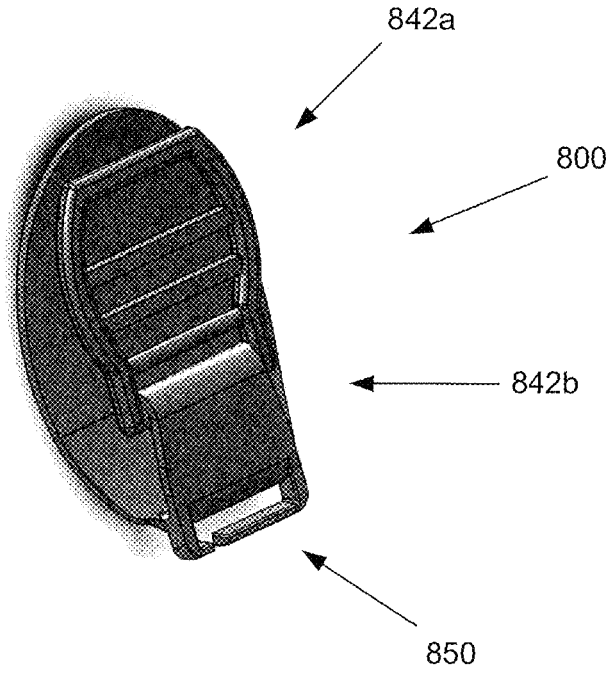
FIGS. 12 and 13 illustrate another example of a DSI.
Figure 13:
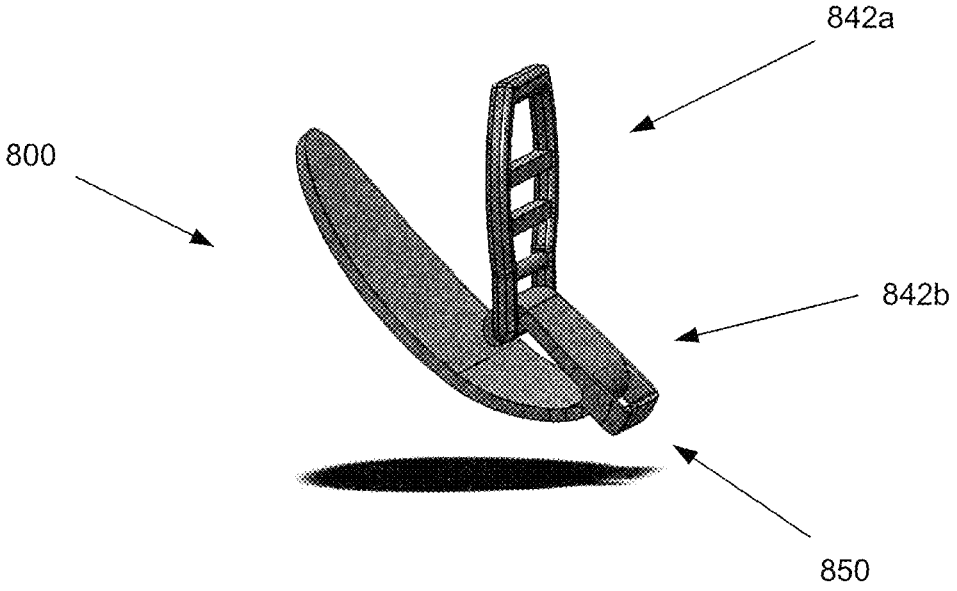

FIGS. 12 and 13 illustrate another DSI embodiment example 800. DSI 800 includes buckle-end 842*a* for interfacing with at least one upper strap, and a channel-portion 842*b* for interfacing with at least one lower strap. DSI 800 further includes a secondary aperture 850. In this example, the secondary aperture is positioned below the channel shelf, but other examples, it may be positioned in other ways. Secondary apertures are useful for, inter alia, securing the tag end of an upper or lower strap.

Figure 14:
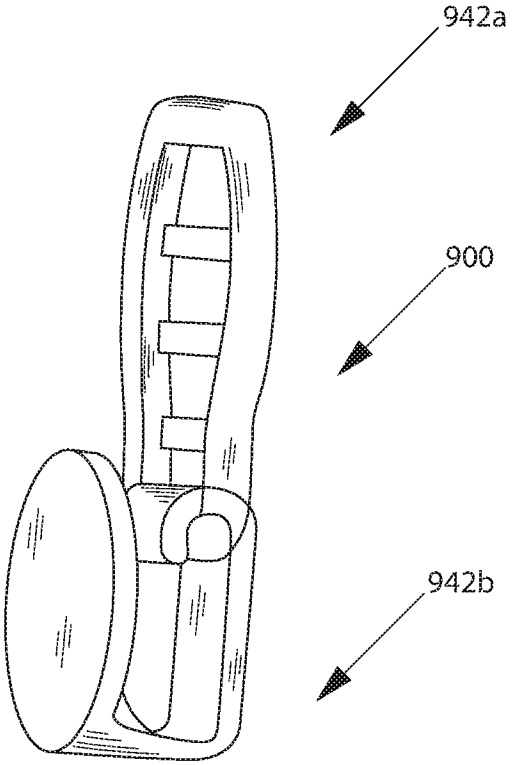
FIG. 14 illustrates another example of a DSI.

FIG. 14 illustrates another DSI embodiment example 900. DSI 900 includes buckle-end 942*a* for interfacing with at least one upper strap, and a channel-portion 942*b* for interfacing with at least one lower strap. DSI 900 is somewhat similar to DSI 300 previously described.

Figure 15:
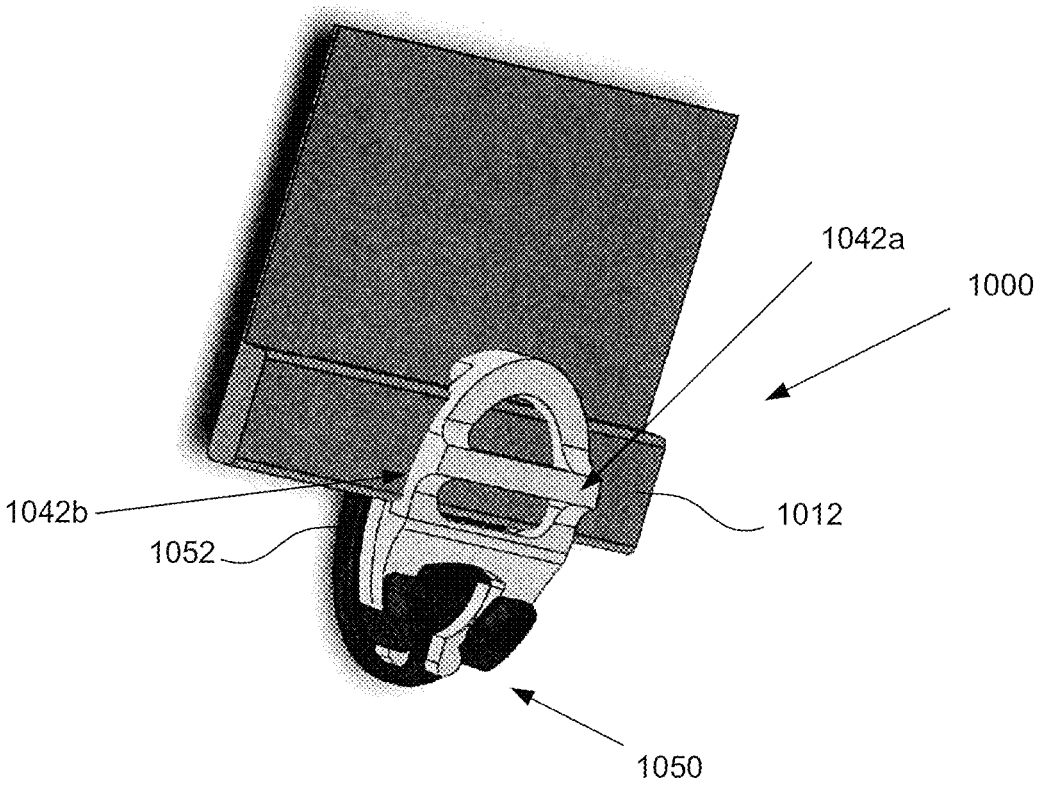
FIG. 15 illustrates another example of a DSI.

FIG. 15 illustrates another DSI embodiment example 1000. DSI 1000 includes buckle-end 1042*a* for interfacing with at least one upper strap (not shown), and a channel-portion 1042*b* for interfacing with at least one lower strap (1012). Channel-portion 1042*b* is defined, in part, by plate 1052 which clipably interfaces at portion 1050.

Figure 16:
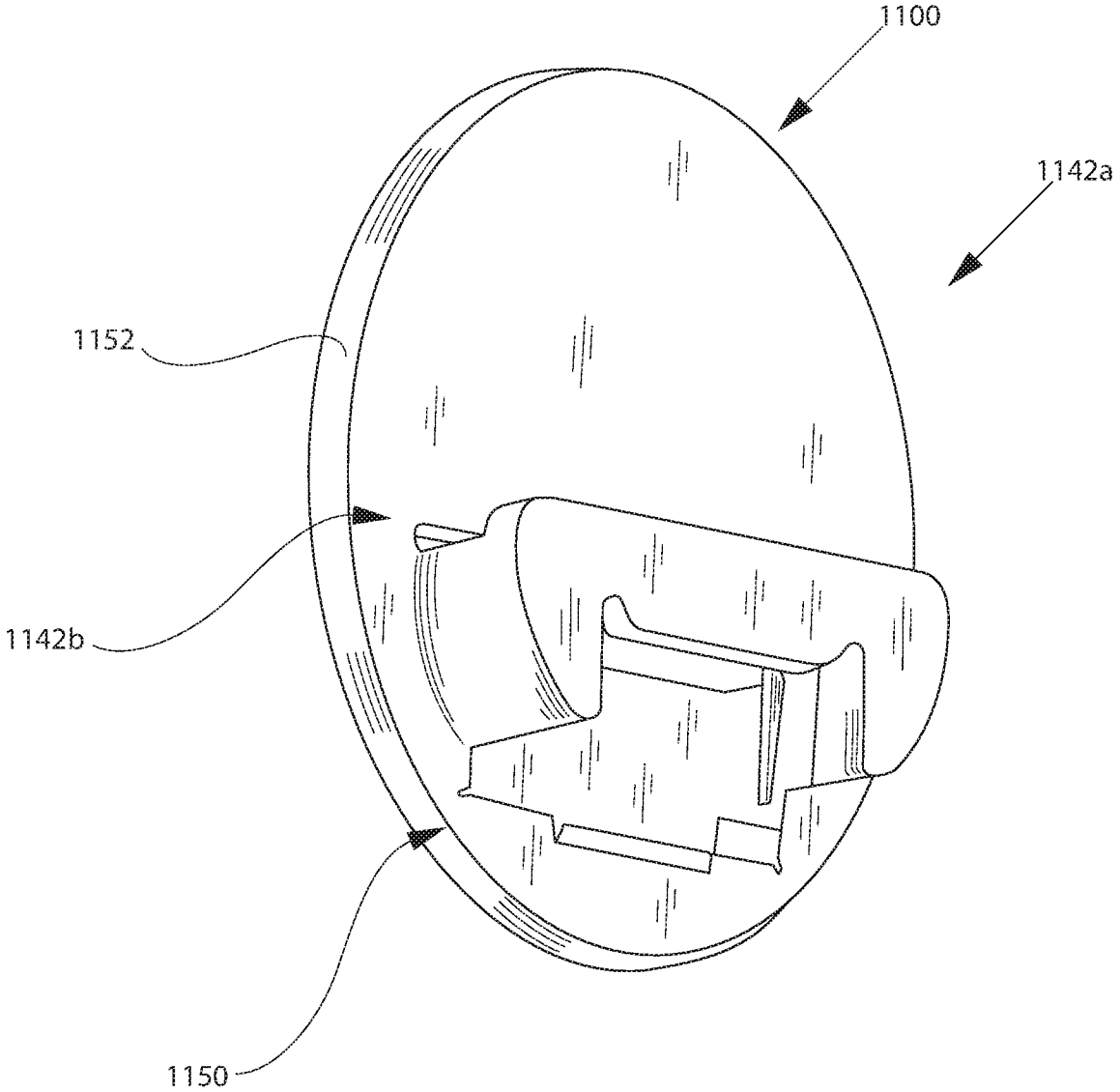
FIG. 16 illustrates another example of a DSI.

FIG. 16 illustrates another DSI embodiment example 1100. DSI 1100 includes buckle-end 1142*a* for interfacing with at least one upper strap (not shown), and a channel-portion 1142*b* for interfacing with at least one lower strap (not shown). Channel-portion 1142*b* is defined, in part, by plate 1152 which clipably interfaces at portion 1150, similarly to DSI 1000.

Figure 17:
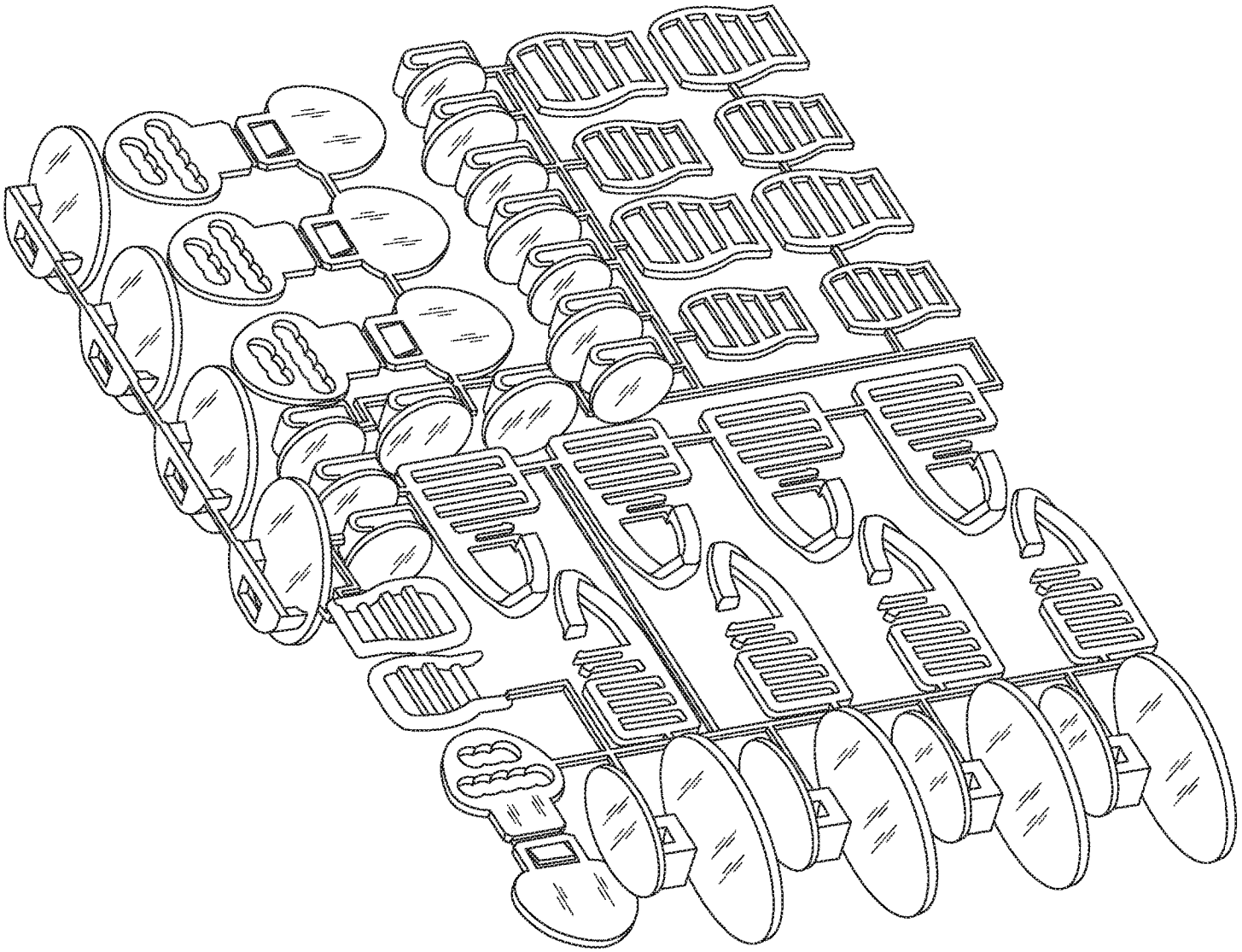
FIG. 17 illustrates another manufacturing layout example.

FIG. 17 illustrates another example of various DSI parts as manufactured.

Figure 18:
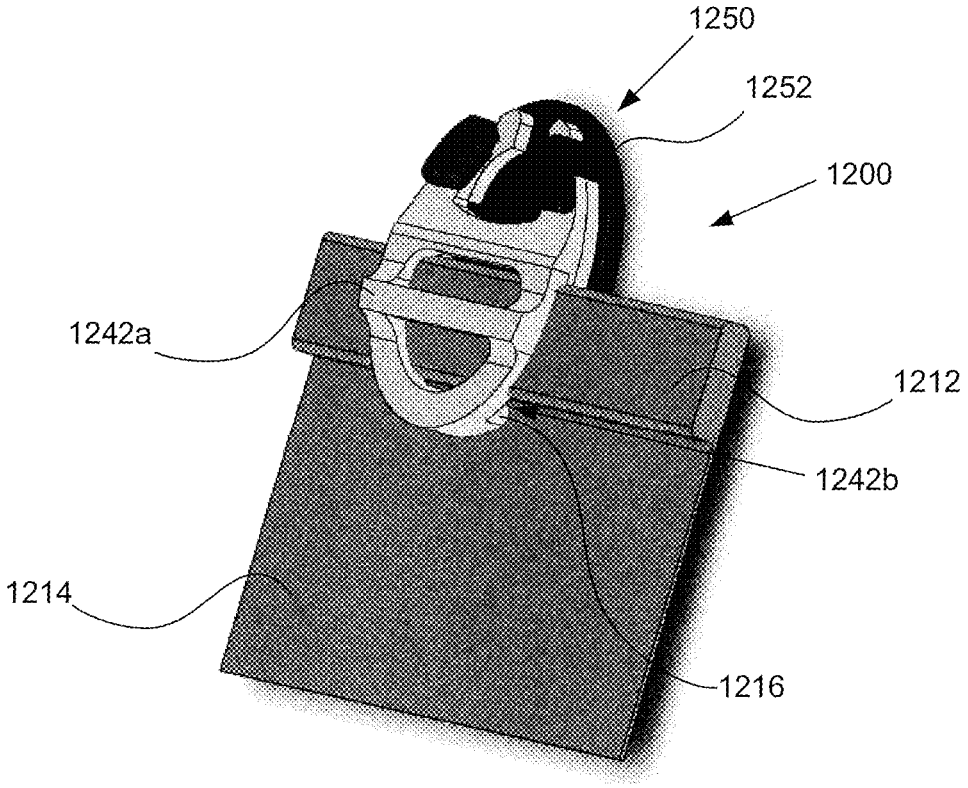
FIG. 18 illustrates another example of a DSI.

FIG. 18 illustrates another DSI embodiment example 1200. DSI 1200 includes buckle-end 1242*a* for interfacing with at least one upper strap (not shown), and a channel-portion 1242*b* for interfacing with at least one lower strap. In this example, the channel-portion is open at its bottom end, as seen, and lower strap 1212 includes the selvedge or edge of a garmet 1214, e.g. a halter-top or tube-top style garment. In this type of example, the DSI uses a clamping force to secure the lower strap. The DSI may similarly include a shelf 1216 to increase purchase on the lower strap. Clamping force may be facilitated, at least in part, by plate 1252, which clipably interfaces at portion 1250. In this example, the clipable interface at portion 1250 acts as a biasing hinge to provide clamping force, but other examples, may include springs, or other structures to provide and inward clamping force.

It should be clear from the above disclosure that systems and DSI disclosed herein encompass a variety of embodiments, the parts of which are not considered to mutually exclusive, e.g. DSI structure may be exchanged amongst the various embodiments, any of the DSI examples may be used with various systems, etc.

The current disclosure is also directed to methods of converting garments to a second configuration. In one example, a method includes obtaining any of the garments mentioned above, attaching one of the pair of upper straps to any of the DSIs mentioned above, and attaching the DSI to at least one of said pair of lower straps. Methods may also include attaching additional DSI.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

What is claimed is:

1. A convertible garment system for a user, the system comprising:

a garment having a pair of breast cups, a pair of upper straps connected to the pair of breast cups and extendable upwardly configured for connecting behind a neck of the user in a first configuration, whereby the user's neck, at least in part, is configured to support a load of the pair breast cups, a pair of lower straps connected to the pair of breast cups and extendable laterally for adaptively connecting behind a back of the user; and at least one detachable-strap-interface, said detachable-strap-interface including:

a base plate for receiving at least one of the upper straps of the pair of upper straps, the base plate having a buckle end and a pivot end, wherein the buckle end of the base plate comprises an upper aperture and a lower aperture, the upper aperture and the lower aperture separated by an upper arm and framed completely on each side by side arms, the upper aperture configured to receive at least one of the upper straps of the pair of upper straps and to removably connect to at least one of the upper straps of the pair of upper straps, wherein the pivot en of the base plate defines a bottom aperture separated from the lower aperture by a lower arm with the bottom aperture defined on one side by a pivot bar and framed on two sides by extensions of the side arms to form an enclosed perimeter around the bottom aperture, an ovular shaped channel-portion removably attached to the base plate by way of the pivot end of the base plate, the channel-portion configured to removably connect to at least one of the lower straps of the pair of lower straps, the channel-portion forming a channel arm having a substantially u-shaped pivot recess at one distal end configured to receive the pivot bar, and a channel shelf at the other distal end of the channel arm, the channel shelf including a curved lower end that attaches to a channel plate, and forms a shelf configured to enclose at least one of the lower straps of the pair of lower straps in an interior face of the channel portion, wherein the substantially u-shaped pivot recess and the channel shelf are spaced apart from one another on one side of the channel-portion, and the channel plate secured to the base plate by way of the channel portion, the channel plate variable between a first clamped position that is substantially parallel to the base plate and exerts a clamping force for securing at least one of the lower straps of the pair of lower straps, and a second retracted position that places the channel plate in a non-parallel position, extended away from the base plate, the channel plate having a height at least that of the base plate when channel plate is in the first clamped position, wherein the clamping force is formed between the channel plate and the channel portion, the channel plate forming a self-guiding structure that guides at least one of the lower straps of the pair of lower straps of the garment into the channel plate.

2. The system of claim 1, wherein said upper and lower apertures are sized to be threaded by at least one of the upper straps of the pair of upper straps, thereby binding said at least one of the upper straps of the pair of upper straps.

3. The system of claim 2, wherein said detachable-strap-interface further includes a detachable face configured to interface with said buckle-end.

4. The system of claim 3, wherein said interface of said detachable face provides a cover for the base plate.

5. The system of claim 3, wherein the pair of side arms are outwardly curved and shaped to interface with said detachable face.

6. The system of claim 1, wherein said channel-portion shelf is configured for applying upward pressure to at least one of the lower straps of the pair of lower straps.

7. The system of claim 6, wherein a top end of said channel-portion defines an opening for receiving at least one of said lower straps of the pair of lower straps.

8. The system of claim 1, wherein said channel plate is pivotally attached to said base plate.

9. The system of claim 8, wherein said channel plate is configured to pivot open to allow said user to engage at least one of the lower straps of the pair of lower straps, and is configured to pivot closed for use.

10. The system of claim 9, wherein the pivot bar mates with said pivot recess, the pivot recess configured for receiving said pivot bar in a manner that allows said channel plate to pivot relative to said base plate.

11. The system of claim 8, wherein said channel plate includes a cover extending upwardly from said channel portion and configured to be distal from said user.

12. The system of claim 8, wherein at least one of said upper aperture and said lower aperture define an opening axis that is non-parallel with an opening axis defined by the channel portion.

13. The system of claim 1, wherein said channel-portion includes an inwardly shaped curved lip at a top end forming the pivot recess.

14. The system of claim 1 further including a cushion surface positioned on at least one of said channel-portion and said buckle-end.

15. The system of claim 1, further including a second detachable-strap-interface attached to at least one of the lower straps of the pair of lower straps and at least one of the upper straps of the pair of upper straps.

16. A detachable-strap-interface for converting a garment to a second configuration, said garment having a pair of breast cups, a pair of upper straps connected to the pair of breast cups and extendable upwardly for adaptively connecting behind a neck of a user in a first configuration, and a pair of lower straps connected to the pair of breast cups and extendable laterally for adaptively connecting behind a back of the user, said detachable-strap-interface consisting essentially of:

a channel-portion configured to removably connect to at least one of the lower straps of the pair of lower straps;

a base plate configured to removably connect to at least one of the upper straps of the pair of upper straps, wherein a buckle end of the base plate comprises an upper aperture and a lower aperture, the upper aperture and the lower aperture separated by an upper arm and framed completely on each side by side arms, the upper aperture configured to receive an upper strap of the pair of upper straps of the garment and to removably connect to at least one of the upper strap of the pair of upper straps, and a channel plate configured to exert a clamping force on at least one of the lower straps of the pair of lower straps for securing at least one of the lower straps of the pair of lower straps in place, wherein the channel portion is positioned between the base plate and the channel plate and the channel portion removably interfaces with the base plate at a channel recess on one end of the channel portion, and the channel plate attaches to the channel-portion at an opposite end from the channel recess end of the channel portion, and the channel plate attached to the channel portion exceeds the length of the base plate, and wherein a pivot recess and a channel shelf are spaced apart from one another on one side of the channel-portion.

17. The detachable-strap-interface of claim 16, wherein said base plate includes a buckle end defining the upper aperture and the lower aperture, wherein said upper and lower apertures are sized to be threaded by at least one of the upper straps of the pair of upper straps, thereby binding said at least one of the upper straps of the pair of upper straps, and wherein said channel-portion includes a channel including a shelf at its bottom end, said channel being configured to receive at least one of the lower straps of the pair of lower straps.

18. The detachable-strap-interface of claim 17, wherein the base plate includes a pivot bar and said channel plate includes a pivot recess for receiving said pivot bar in a manner that allows said channel plate to pivot relative to said base plate, wherein said channel plate is configured to pivot open to allow said user to engage at least one of the lower straps of the pair of lower straps, and is configured to pivot closed for use.

19. The detachable-strap-interface of claim 17, wherein said channel plate includes a cover extending upwardly from said channel and configured to be distal from said user.

20. The detachable-strap-interface of claim 17, wherein at least one of said upper aperture and said lower aperture define an opening axis that is non-parallel with an opening axis defined by the channel portion.

21. The detachable-strap-interface of claim 17, wherein said channel-portion further defines a secondary aperture positioned below the channel plate.

22. The detachable-strap-interface of claim 16, wherein said buckle-end includes an upper aperture and a lower aperture, wherein said upper and lower apertures are sized to be threaded by at least one of the upper straps of the pair of upper straps, thereby binding said at least one of the upper straps of the pair of upper straps, and wherein said channel-portion includes a shelf for applying upward pressure to at least one of the lower straps of the pair of lower straps.

23. The detachable-strap-interface of claim 16 further including a cushion surface positioned on at least one of said channel-portion and said buckle-end.

* * * * *